US011697138B2

(12) United States Patent
Hayden et al.

(10) Patent No.: US 11,697,138 B2
(45) Date of Patent: Jul. 11, 2023

(54) CLEANING DEVICES FOR PERSONAL CARE TOOLS

(71) Applicant: Rheem Manufacturing Company, Atlanta, GA (US)

(72) Inventors: Christopher M. Hayden, Waterbury, CT (US); Sergiu G. Mihu, Waterbury, CT (US); Eric Jurczyszak, Waterbury, CT (US)

(73) Assignee: Rheem Manufacturing Company, Atlanta, GA (US)

( * ) Notice: Subject to any disclaimer, the term of this patent is extended or adjusted under 35 U.S.C. 154(b) by 501 days.

(21) Appl. No.: 16/828,261

(22) Filed: Mar. 24, 2020

(65) Prior Publication Data

US 2021/0299710 A1 Sep. 30, 2021

(51) Int. Cl.

| | |
|---|---|
| ***B08B 3/10*** | (2006.01) |
| ***B08B 3/04*** | (2006.01) |
| ***B08B 3/08*** | (2006.01) |
| *E03C 1/04* | (2006.01) |

(52) U.S. Cl.

CPC ..... *B08B 3/10* (2013.01); *B08B 3/041* (2013.01); *B08B 3/045* (2013.01); *B08B 3/08* (2013.01); *B08B 2203/007* (2013.01); *E03C 1/0401* (2013.01)

(58) Field of Classification Search

CPC ..... B08B 3/10

See application file for complete search history.

(56) References Cited

U.S. PATENT DOCUMENTS

| | | | | |
|---|---|---|---|---|
| 2009/0193575 | A1* | 8/2009 | Prian | A47K 3/38 4/558 |
| 2009/0301528 | A1* | 12/2009 | Goddard | B08B 3/02 134/32 |
| 2011/0036377 | A1 | 2/2011 | McClure et al. | |
| 2019/0045980 | A1* | 2/2019 | Yu | F16K 31/02 |

FOREIGN PATENT DOCUMENTS

| | | | |
|---|---|---|---|
| WO | 2015/110786 | A1 | 7/2015 |
| WO | 2015/116506 | A2 | 8/2015 |

OTHER PUBLICATIONS

International Search Report and Written Opinion for PCT Application No. PCT/US2021/022920 dated Jun. 10, 2021.

Marketing materials for the Braun Male Grooming Clean and Charge station, retrieved on Mar. 3, 2020, available at https://us.braun.com/en-us/male-grooming/clean-charge-station.

* cited by examiner

*Primary Examiner* — Jason Y Ko

(74) *Attorney, Agent, or Firm* — Eversheds Sutherland (US) LLP

(57) ABSTRACT

The disclosed technology includes a cleaning device for cleaning personal care tools, such as toothbrushes and shaving razors. The cleaning device can include a heating element configured to heat cleaning fluid received by the cleaning device and a high pressure nozzle configured to output heated cleaning fluid into the cleaning chamber.

20 Claims, 9 Drawing Sheets

CLEANING DEVICES FOR PERSONAL CARE TOOLS

BACKGROUND

Most people typically regularly use one or more personal care tools, such as a toothbrush or a shaving razor. However, users of these tools are generally unlikely to clean the tools on a regular basis, which can have many undesired effects. For example, the useful life of the tools can be reduced due to poor cleaning or maintenance of the tool. This, in turn, can increase waste as users will require additional tools to replace old, discarded tools. As another example, an uncleaned tool can become home to bacteria. Thus, in the case of a toothbrush, an unclean tool can lead to regular introduction of bacteria into the mouth of the user, which can help cause the user to become ill. An unclean razor can cause irritation to and/or infection of the user's skin.

Users can rinse a razor using a bathroom faucet. While this may remove some of the shaved hair from the razor, the temperature of water available from a bathroom faucet is generally insufficient to kill bacteria. Further, rinsing a razor (or other tool) with a bathroom faucet can require a large amount of water. As an illustrative example, assuming that a user averages 5 minutes per shave and shaves every other day using a bathroom faucet that provides 2.2 gallons of water per minute, the user will use over 2000 gallons of water per year. Using such a large amount of water for rinsing a razor or other personal care tool can be undesirable and even detrimental in communities where water resources are scarce.

What is needed, therefore, are systems and devices for cleaning personal care tools.

SUMMARY

These and other problems can be addressed by the technology disclosed herein. The disclosed technology includes a cleaning device for cleaning personal care tools. The cleaning device can include a cleaning chamber having an entrance for receiving at least a portion of a personal care tool, a heating element configured to heat cleaning fluid received by the cleaning device, and a high pressure nozzle configured to output heated cleaning fluid into the cleaning chamber.

The cleaning device can include a pump configured to pump fluid to the nozzle.

The cleaning fluid can comprise alcohol or hydrogen peroxide.

The cleaning fluid can be water.

The cleaning device can include an inlet configured to receive water from a plumbing line.

The cleaning device can include a waste outlet configured to discharged waste water.

The cleaning device can include a filter configured to filter used cleaning fluid.

The filter can be integrated into a removeable filter cartridge.

The cleaning device can include a cleaning fluid reservoir configured to supply cleaning fluid to the heating element and the high pressure nozzle.

The cleaning device can include a waste reservoir configured to receive used cleaning fluid.

The cleaning device can be configured to attach to a sink or a countertop associated with the sink.

The cleaning device can include a mesh liner disposed within the cleaning chamber.

The cleaning device can include a motor configured to rotate the cleaning chamber.

The cleaning device can include a barrier configured to prevent cleaning solution from escaping the entrance of the cleaning chamber.

The barrier can include an air curtain.

The barrier can include a sliding curtain.

The barrier can include a plurality of bristles or a plurality of flaps.

The disclosed technology includes a faucet that can include a water outlet configured to distribute water, a heating element configured to heat cleaning fluid, and a high pressure nozzle configured to output heated cleaning fluid.

The faucet can include a sensor configured to detect a personal care tool and a controller. The controller can be configured to receive data from the sensor and, in response to determining that the data indicates detection of a personal care tool, output instructions for the heating element to heat cleaning fluid and the high pressure nozzle to discharge heated cleaning fluid.

The cleaning fluid can be water.

Additional features, functionalities, and applications of the disclosed technology are discussed in more detail herein.

BRIEF DESCRIPTION OF THE FIGURES

Reference will now be made to the accompanying figures, which are not necessarily drawn to scale, and wherein.

DETAILED DESCRIPTION

Figure 1:
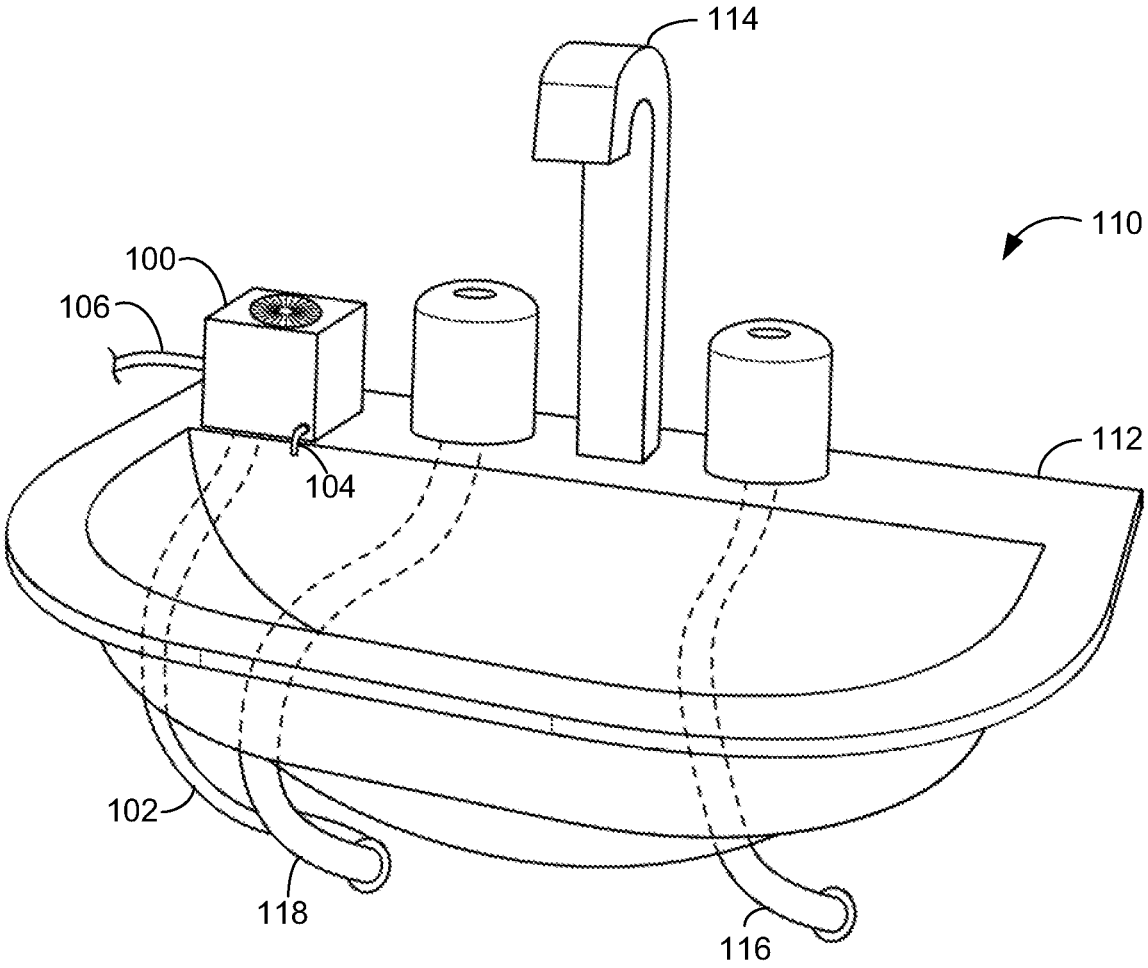
FIG. 1 illustrates a perspective view of an example cleaning device located on a bathroom countertop, in accordance with the disclosed technology.

Throughout this disclosure, certain examples are described in relation to cleaning devices and systems for cleaning personal care tools. As used herein, the term "personal care tools" refers to toothbrushes, shaving razors, beard trimming scissors, fingernail clippers, nail files, tweezers, and the like, unless otherwise specified. Thus, the disclosed technology can be effective in removing debris from a personal care tool (e.g., removing hair shavings from a razor), but the disclosed technology is not so limited. For example, the disclosed technology can be effective in sanitizing personal care tools, as will be discussed more fully herein.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example," "an example," "some examples," "certain examples," "various examples," etc., indicate that the embodiment(s) and/or example(s) of the disclosed technology so described may include a particular feature, structure, or characteristic, but not every embodiment, example, or implementation in accordance with the disclosed technology necessarily includes the particular feature, structure, or characteristic. Further, use of the phrases "in one embodiment" and/or "in one example" does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

The disclosed technology relates to a cleaning device. The cleaning device can be useful for cleaning, sanitizing, and/or disinfecting objects, such as one or more types of personal care tools. As will be described more fully below, the cleaning device can be a standalone device that can be set beside or near an existing sink (e.g., a bathroom sink). The cleaning device can be configured to receive fluid, such as water, from an existing plumbing network and/or a reservoir, and the cleaning device can be configured to output used fluid and/or waste materials through a waste outlet and/or to a waste reservoir. As an example, the cleaning device can be configured to output waste cleaning fluid into the existing sink. As further examples, the cleaning device can be integrated into a sink or vanity countertop or faucet and can be configured to output waste fluid directly to a sewer plumbing network.

Although the disclosed technology is often discussed herein as being compatible with existing water plumbing systems or other sources of water for cleaning purposes, it is within the scope of this disclosure that the disclosed technology can be configured to clean, sanitize and/or disinfect personal care tools using a solution that includes alcohol, hydrogen peroxide, or the like.

FIG. 1 illustrates a diagram of an example cleaning device 100 that is installed beside a sink 110. More specifically, the cleaning device 100 is shown as being installed on a countertop 112 of the sink 110. The disclosed technology, however, is not so limited. For example, the cleaning device 100 can be configured to couple, attach, or adhere to an inner surface of the sink 110's basin. As shown, the cleaning device 100 can be configured to receive fluid, such as water, from a plumbing line 102 (e.g., pipe, hose). For example, the cleaning device 100 can be configured to receive water via the plumbing line 102 from the cold-water line of the sink 110 (or another cold water source), the hot-water line of the sink 110 (or another hot water source), or a combination thereof. The cleaning device 100 can include a waste outlet 104 that is configured to discharge waste fluid and/or waste material. As used herein, the term "waste fluid" can refer to a fluid that has been used for cleaning a personal care tool unless otherwise noted, and the term "waste material" can refer to contaminants, residues, and other materials that have been removed from a personal care tool by the cleaning device 100. For example, toothpaste particles (e.g., toothpaste residue or remnants removed from a toothbrush) would be considered a waste material, and hair shavings (e.g., hair shavings removed from a shaving razor) would be considered a waste material. The cleaning device can include a power cord 106 configured to receive electricity from an energy source, such as an electrical outlet. Alternatively or in addition, the cleaning device 100 can include or be connected to a battery such that the cleaning device can be battery powered.

Figure 2:
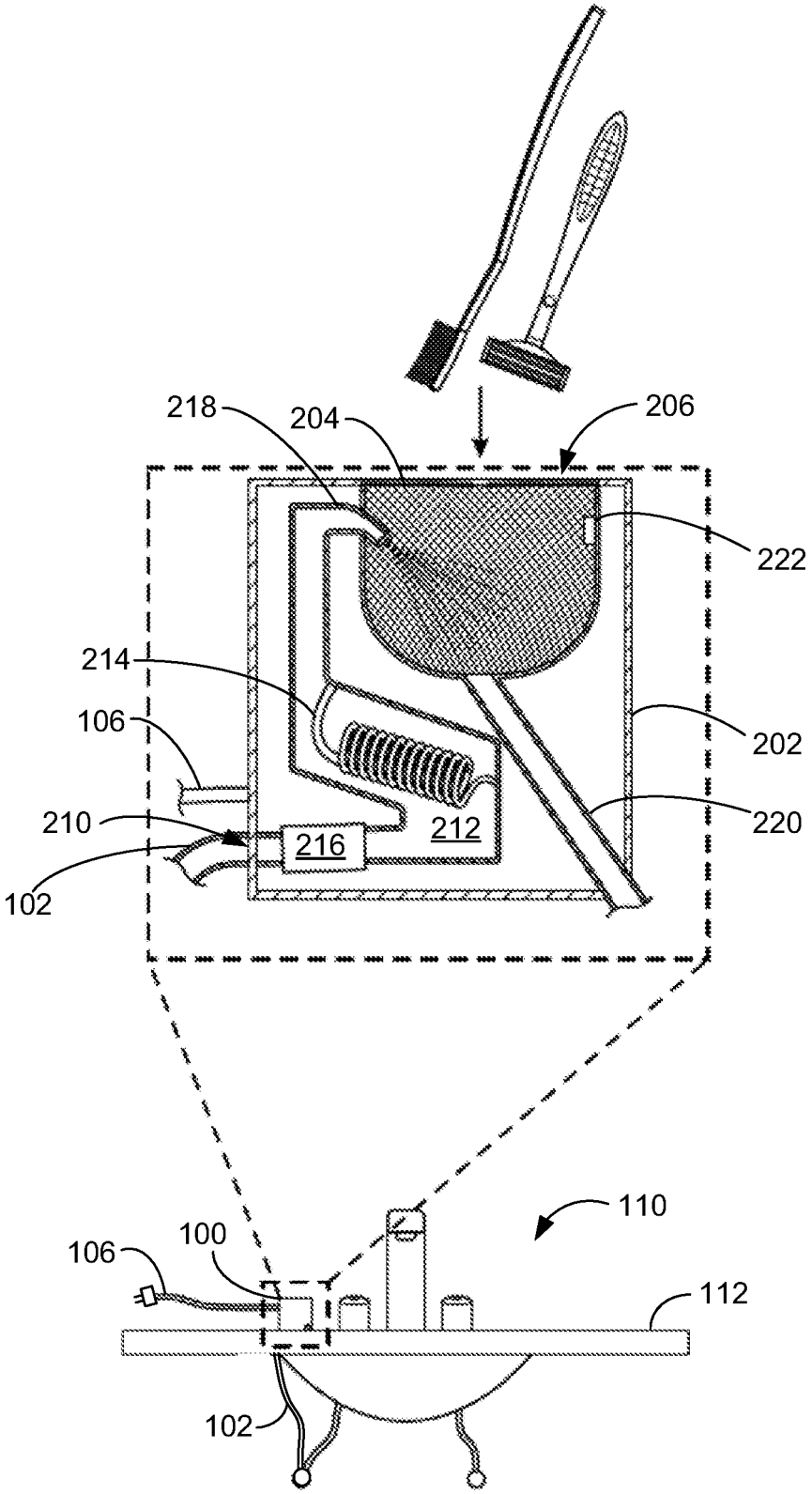
FIG. 2 illustrates a cross-sectional schematic view of an example cleaning device located on a bathroom countertop, in accordance with the disclosed technology.

Referring to FIG. 2, the cleaning device 100 can have an outer shell 202, which can include one or more outer walls. For example, the outer shell 202 can include a top, a bottom, and one or more side walls. The outer shell 202 can comprise plastic, metal, ceramic, or any combination thereof. The cleaning device 100 can be installed on or to a sink 110. For example, the cleaning device can be installed on or to a sink's vanity countertop and/or to a surface of the sink's basin. The cleaning device 100 can be detachably attachable to the sink 110 or a portion of the sink 110, such as by a suction-based attachment system (e.g., a suction cup). Alternatively, the cleaning device 100 can be permanently installed to the sink 110 or a portion of the sink 110 via adhesive, fastening mechanisms (e.g., screws, bolts), or any other attachment method. Alternatively still, the cleaning device 100 can be integrated into a sink 110 or vanity countertop and can be configured to output waste fluid directly to a sewer plumbing network. The cleaning device 100 can include a cleaning chamber 204 that is configured to receive at least a portion of a personal care tool. The cleaning chamber 204 can be accessible via an entry aperture 206 through a portion of the outer shell 202.

The cleaning device 100 can be configured to receive fluid (e.g., water) via an inlet 210. For example, the inlet 210 can be in fluid communication with the plumbing line 102. The fluid can flow from the inlet into a heating chamber 212 that includes one or more heating elements 214 configured to heat the incoming fluid. The heating element(s) 214 can be a Joule or resistance heating element (e.g., coil, ribbon, length of wire) or any other useful type of heat source. The heating element(s) 214 can be configured to heat the fluid to a predetermined temperature or to a temperature within a predetermined temperature range. Alternatively or in addition, the heating element element(s) 214 can be configured to heat the fluid to a user-inputted temperature or to a temperature within a user-inputted temperature range.

The fluid, whether heated or not, can be discharged into the cleaning chamber 204 to clean a personal care tool inserted into the cleaning chamber 204. The cleaning device 100 can include a pump 216 configured to increase the pressure of the incoming fluid, and the fluid can be discharged into the cleaning chamber 204 via one or more nozzles 218. Thus, by increasing the flow rate of the fluid as it is applied to the personal care tool, the cleaning device 100 can clean, sanitize, and/or disinfect a personal care tool using less fluid than many traditional cleaning methods and devices. Although FIG. 2 depicts the pump 216 as being disposed along a fluid path between the inlet 210 and the heating chamber 212, the pump 216 can be located in any location between the inlet 210 and the nozzle(s) 218. For example, the pump 216 can be located between the heating chamber 212 and the nozzle(s) 218. The pump 216 can be any useful type of pump or combination of pumps. As non-limiting examples, the pump 216 can include a self-priming vane pump, a capillary pump, a diaphragm pump, and the like.

The cleaning device 100 can include a discharge portion 220 for waste fluid (i.e., used cleaning fluid) and/or waste materials to exit the cleaning chamber. The discharge portion 220 can be in fluid communication with the waste outlet 104 that is shown more clearly in FIG. 1. The discharge portion 220 and waste outlet 104 can be configured to discharge waste fluid and/or waste materials into the sink 110's basin. Alternatively or in addition, the discharge portion 220 and waste outlet 104 can be configured to discharge waste fluid and/or waste materials into a waste reservoir.

The cleaning device 100 can also include one or more sensors shown representatively as sensor 222. The sensor 222 can be configured to detect when a personal care tool has been inserted into the cleaning chamber 204. For example, the sensor 222 can include a mass sensor configured to determine when an object having a mass within a predetermined or user-inputted mass range has been placed in the cleaning chamber 204. As another example, the sensor 222 can include a heat sensor configured to detect a heat signature of any object located within the cleaning chamber 204. As yet another example, the sensor 222 can be an optical sensor configured to detect motion and/or detect when an object passes within a predetermined distance from the sensor 222. As will be appreciated, the location of the sensor 222 within the cleaning chamber 204 or cleaning device 100 can be related to the type of sensor used in the cleaning device 100. For example, it can be useful to locate a mass sensor at or near the bottom of the cleaning chamber 204 or below the cleaning chamber 204. Thus, the mass sensor can be located to easily detect changes in mass within the cleaning chamber 204. As another example, it can be useful to locate an optical sensor at or near the entry aperture 206 of the cleaning chamber 204 such that the optical sensor is positioned to detect when an object has entered the cleaning chamber 204.

As discussed more fully below with respect to FIG. 8, the cleaning device 100 can include a controller configured to receive data from various components of the cleaning device 100, apply logic to the received data, and output instructions to various components of the cleaning device 100. As an illustrative example, the controller can receive data from the sensor 222, analyze the data to determine that at least a portion of personal care tool is located within the cleaning chamber 204, and output instructions for the pump 216 and heating element 214 to initiate.

Figure 3:
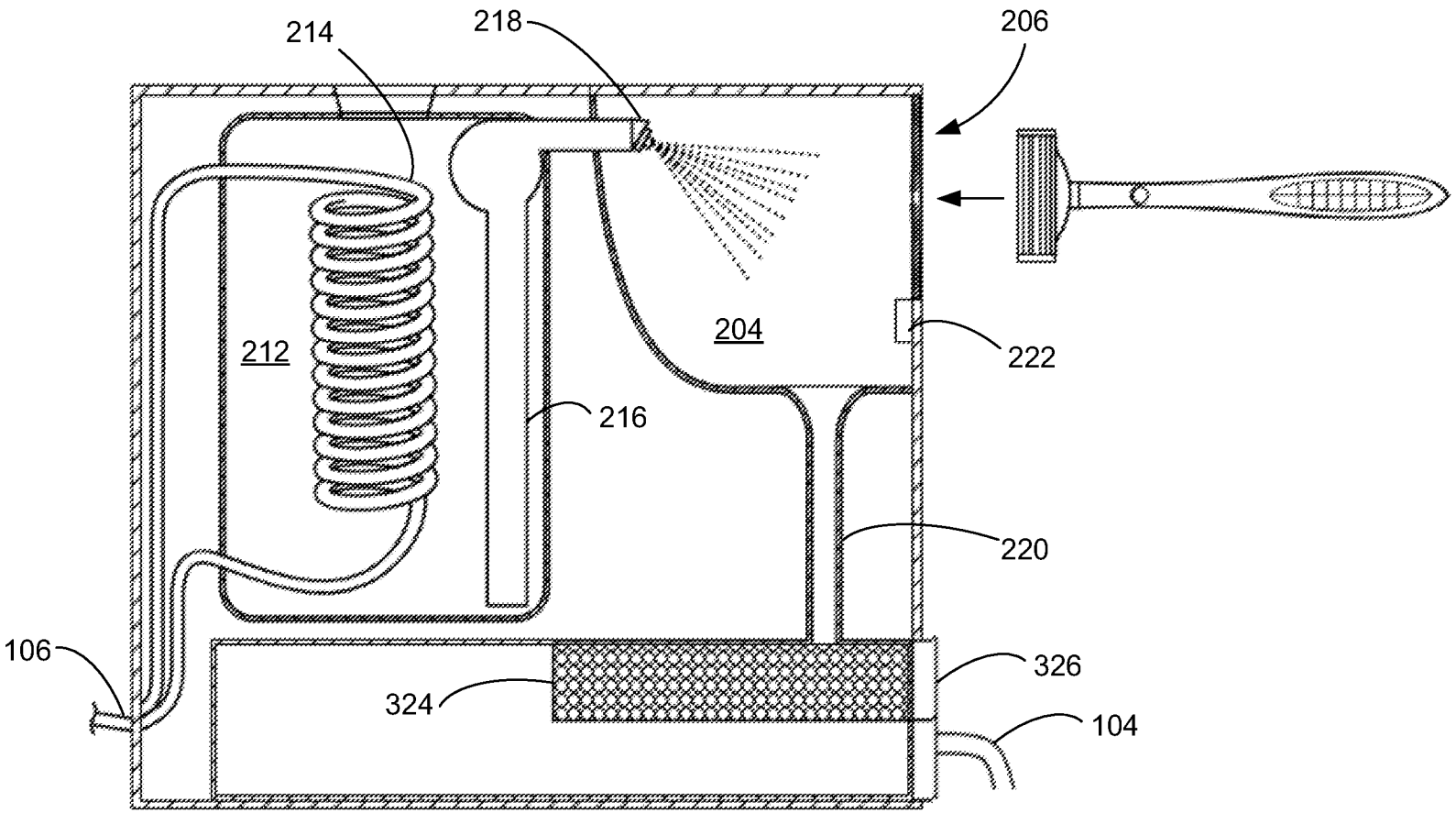
FIG. 3 illustrates a cross-sectional schematic view of an example cleaning device, in accordance with the disclosed technology.

Turning to FIG. 3, the discharge portion 220 can be in fluid communication with a filter 324. That is, the filter 324 can be disposed between the discharge portion 220 and the waste outlet 104. As will be appreciated, the filter 324 can remove waste materials and other materials from the waste fluid. This can be particularly useful in scenarios in which the cleaning device 100 is outputting waste fluid into a sink 110. That is, in these and other scenarios, the filter 324 can be configured to remove waste materials from waste fluid so as to prevent buildup or clogging of the plumbing associated with the sink 110. The filter 324 can comprise any useful media configured to remove waste materials from fluid, which can include but is not limited to mesh filter media, cyclonic filter media, and a settling weir. As will be appreciated, the characteristics of certain filter media or filtration system may be particularly advantageous depending on the configuration of a given cleaning device 100. For example, the use of a settling weir may be helpful to prevent clogging without the need for a specialized filter media. The pore size of the filter 324 can be selected to remove target waste materials from the waste fluid, depending on the intended application(s) of the cleaning device 100 (e.g., cleaning toothbrushes, cleaning shaving razors).

As shown in FIG. 3, the filter 324 can be integrated into a removeable cartridge 326, which can help simplify the discarding and replacement of used filters 324. The cartridge 326 can be configured to slideably insert into and extract out of a receiving port of the cleaning device 100. Notably, certain components (e.g., inlet 210) are omitted from FIG. 3 for clarity.

Figure 4:
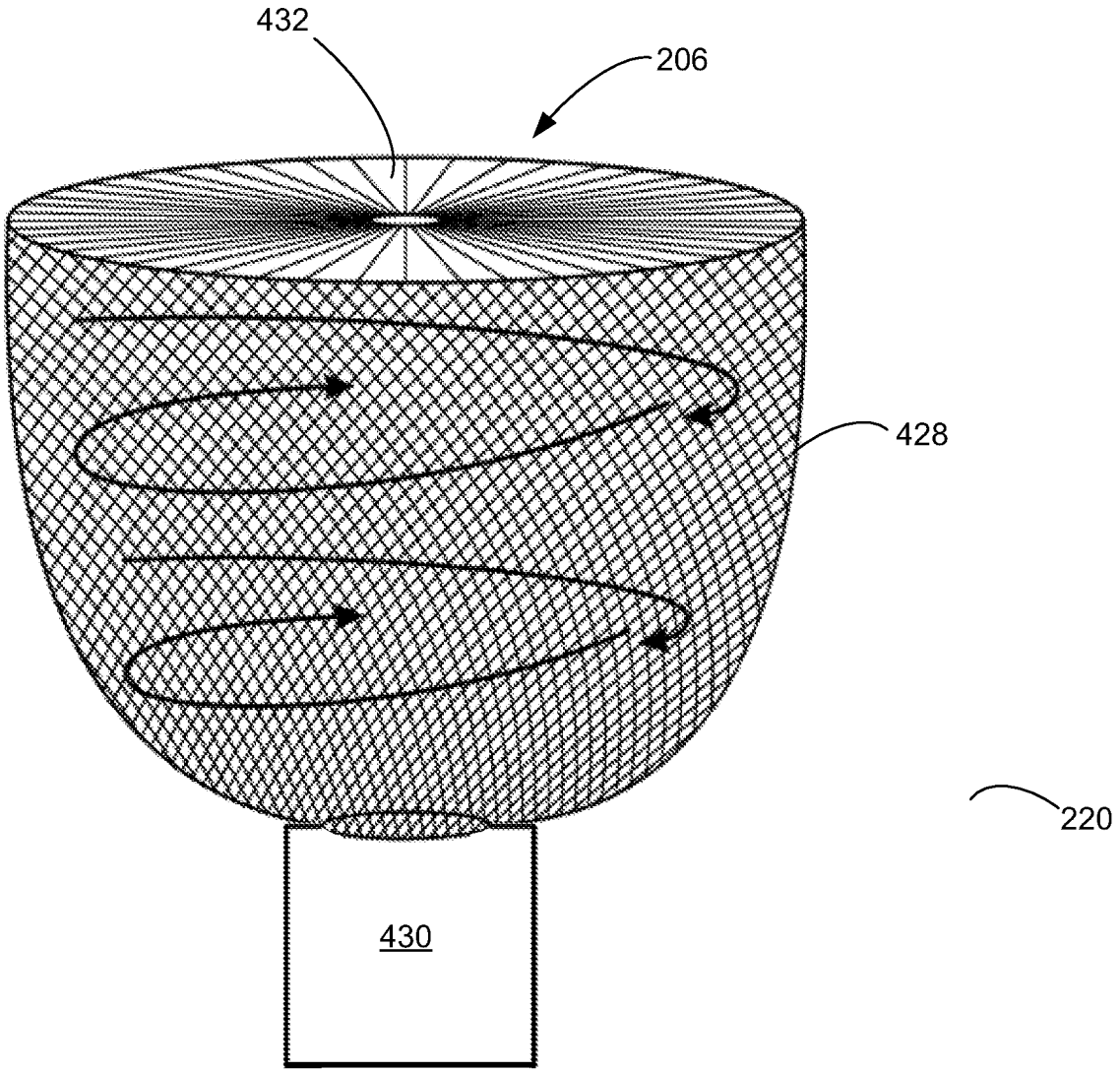
FIG. 4 illustrates a cyclonic component of an example cleaning device, in accordance with the disclosed technology.

Alternatively or in addition to including a cartridge 326, the cleaning device 100 can include a mesh liner 428 included in the cleaning chamber 204 itself, such as is depicted in FIGS. 1 and 4. The mesh liner 428 can have a bucket shape. Alternatively or in addition, the mesh liner 428 can have a shape that complements or mirrors the shape created by the internal surfaces of the cleaning chamber 204. The mesh liner 428 can be removeable and/or replaceable. Alternatively, one or more portions of the walls of the cleaning chamber 204 can include a mesh.

Referring to FIG. 4 specifically, the cleaning chamber 204 can be configured to rotate or vibrate, which can apply forces to the personal care tool that may increase cleaning efficacy of the cleaning device 100. The cleaning chamber 204 can be connected to a motor 430, which can be configured to spin or rotate such that a centrifugal force is imparted to the fluid or objects located within the mesh liner 428 and/or cleaning chamber 204. Alternatively or in addition to the inclusion of a nozzle 218, the cleaning device 100 can be configured to receive a stream of water into the central volume of the mesh liner 428. As the cleaning chamber 204, the mesh liner 428 rotates, centrifugal forces can rotate the fluid about a central axis of the cleaning chamber 204, which can increase the amount of cleaning forces imparted upon a personal care tool inserted into the cleaning device 100. To prevent exit of the cleaning fluid from the cleaning chamber 204, the cleaning device 100 can include a splash guard covering some or all of the entry aperture 206 of the cleaning chamber 204. For example, as shown in FIG. 4, the splash guard can include a plurality of flaps 432 configured to substantially cover the entry aperture 206. The flaps 432 can be configured to bend such that portions of a personal care tool can pass beyond the flaps 432 and into the cleaning chamber 204. The flaps 432 can be configured to return to their normal positions (i.e., substantially covering the entry aperture 206) after any external force is removed from the flaps 432 (e.g., pressing a personal care tool against the flaps 432 and into the cleaning chamber 204). The flaps 432 can have sufficient rigidity to maintain an inserted personal care tool in a predetermined position while the motor 430 spins the cleaning chamber 204. For example, the flaps 432 shown in FIG. 4 define a small central hole and such flaps 432 can be configured to maintain an inserted personal care tool in a substantially upright or vertical position (e.g., approximately along an axis aligned with the central hole of the flaps 432) while the motor 430 spins the cleaning chamber 204.

Figure 5:
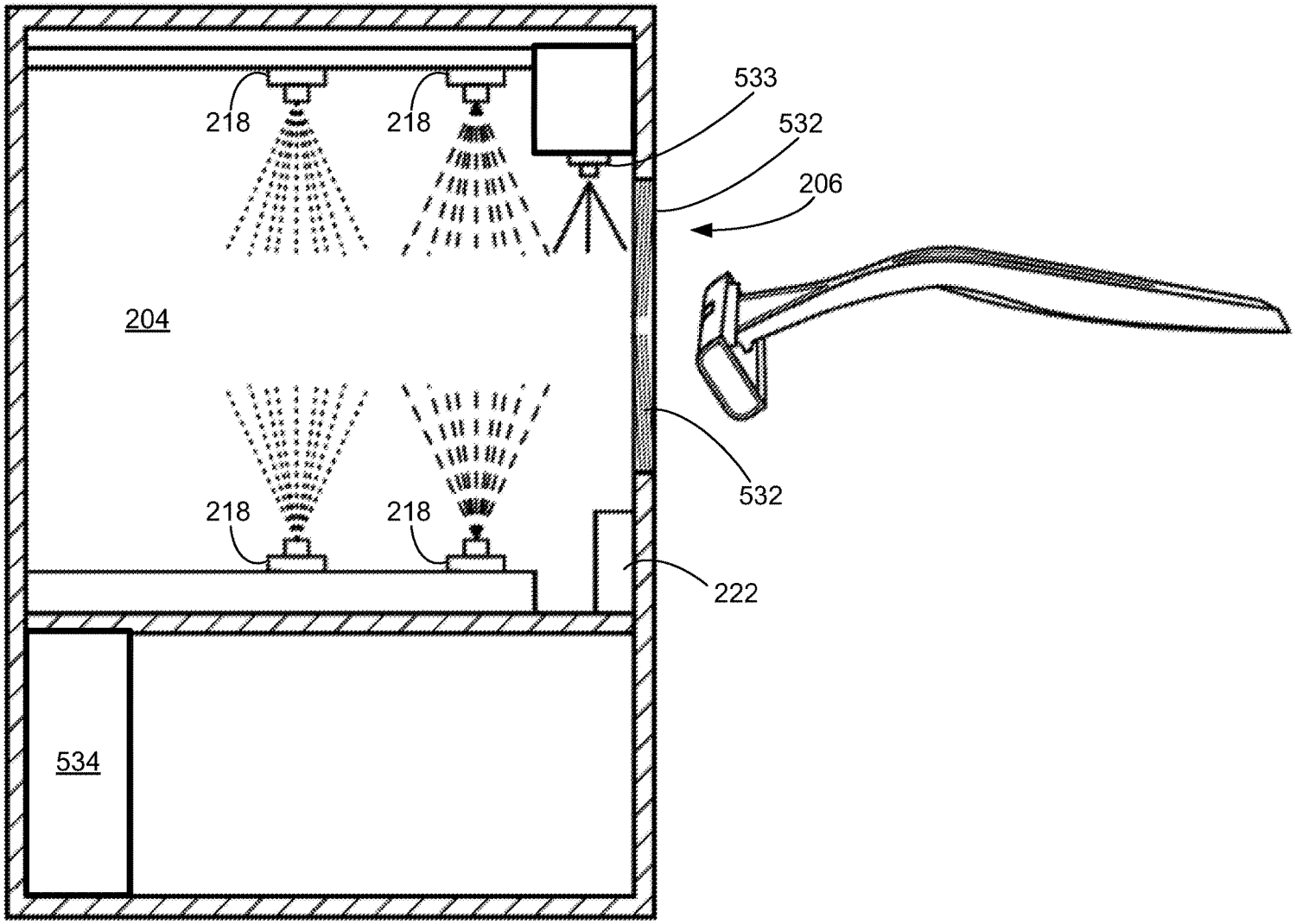
FIG. 5 illustrates a cross-sectional schematic view of another example cleaning device, in accordance with the disclosed technology.

The cleaning device 100 can include other types of splash guards. For example, referring to FIG. 5, the splash guard can include a plurality of bristles 532. The bristles 532 can extend from one side, some sides (e.g., two opposite sides), or all sides of the entry aperture 206, and the bristles 532 can meet at or near a substantially central portion of the entry aperture 206. Alternatively, the bristles 532 can stop short of opposing bristles 532 such that a small gap is provided (e.g., similar to the gap provided by the flaps 432 in FIG. 4). Alternatively or in addition, the splash guard can include an air curtain 533, which can be configured to provide a stream of moving air across the entry aperture 206 to prevent a barrier prevent at least some cleaning fluid or waste materials from escaping the entry aperture 206. The air curtain 533 can receive air from an air compressor 534 or fan included in the cleaning device 100. The air curtain 533 can be configured to engage at all times when the cleaning device 100 is turned on or only while the nozzles 218 are activated and/or while the motor 430 is spinning the cleaning chamber 204, which can reduce the overall energy consumption of the cleaning device 100.

Figure 6:
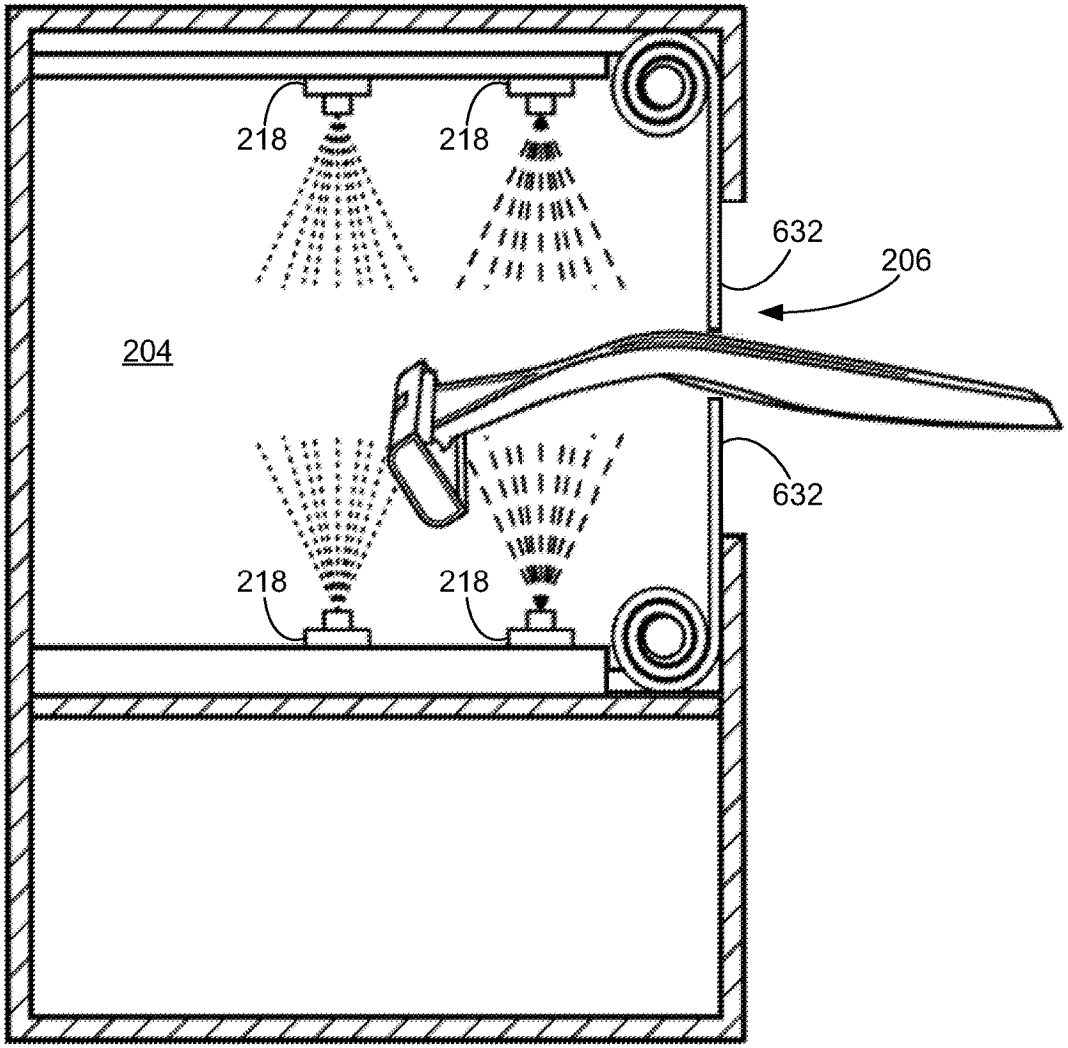
FIG. 6 illustrates a cross-sectional schematic view of another example cleaning device, in accordance with the disclosed technology.

As another example of a splash guard, FIG. 6 illustrates a sliding curtain 632. The sliding The cleaning device can include one sliding curtain 632, two opposing sliding curtains 632 (e.g., as shown in FIG. 6), or more than two sliding curtains 632. Additional sliding curtains 632 may reduce the "open" area between the sliding curtains 632 and/or an edge of the entry aperture 206. The sliding curtain(s) 632 can be configured to extend only while the nozzles 218 are activated and/or while the motor 430 is spinning the cleaning chamber 204. The sliding curtains 632 can comprise plastic or any other material useful to repel and/or contain fluid.

Figure 7:
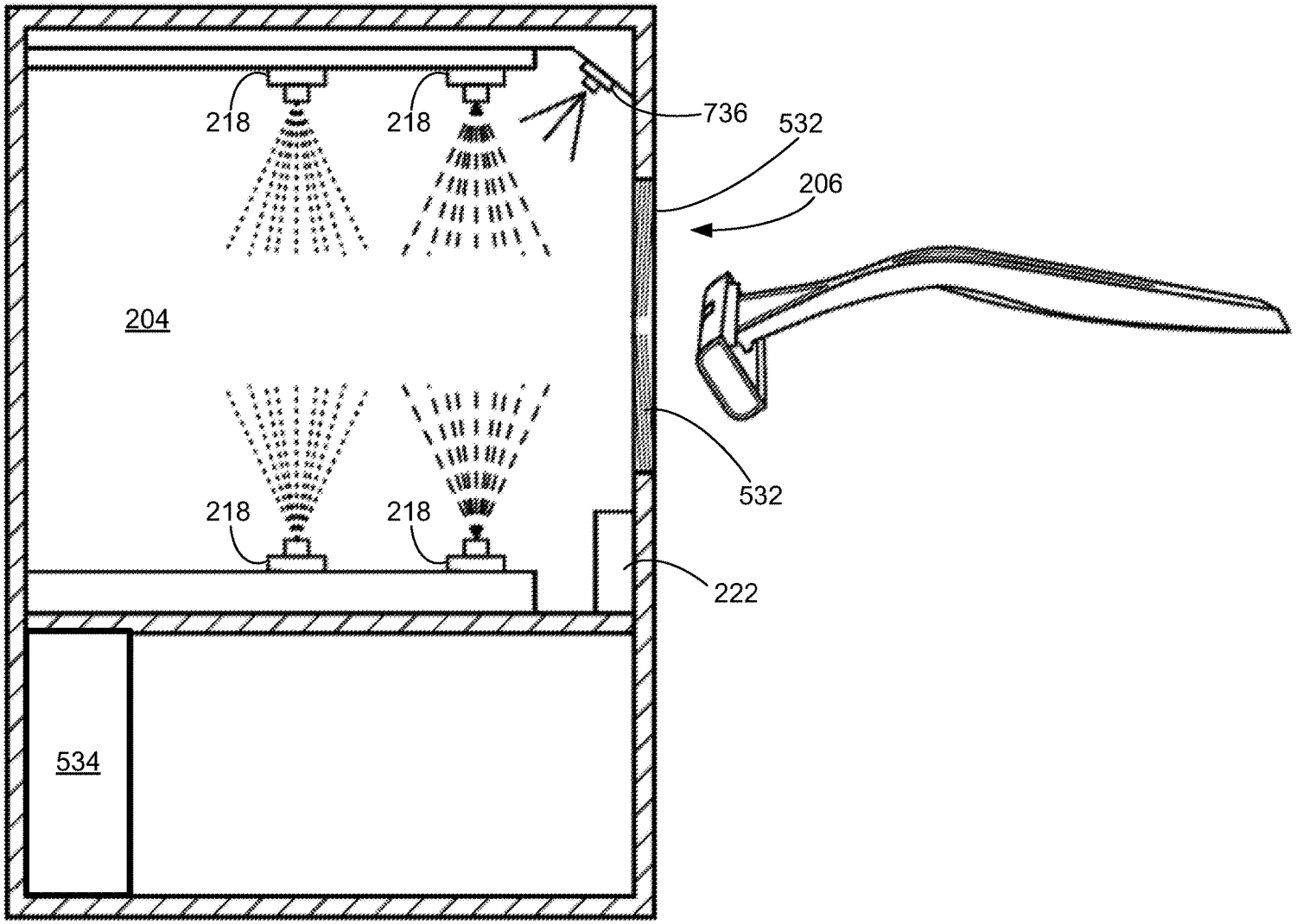
FIG. 7 illustrates a cross-sectional schematic view of another example cleaning device, in accordance with the disclosed technology.

Referring to FIG. 7, the cleaning device 100 can include a drying nozzle 736 configured to provide a burst or blast of air to dry the personal care tool subsequent to cleaning the personal care tool. The drying nozzle 736 can receive air from the air compressor 534 or a fan included in the cleaning device 100. The functionality of the drying nozzle 736 as described herein can be provided by the previously discussed air curtain 533. Alternatively, the drying nozzle 736 and the air curtain 533 can be different components.

Figure 8:
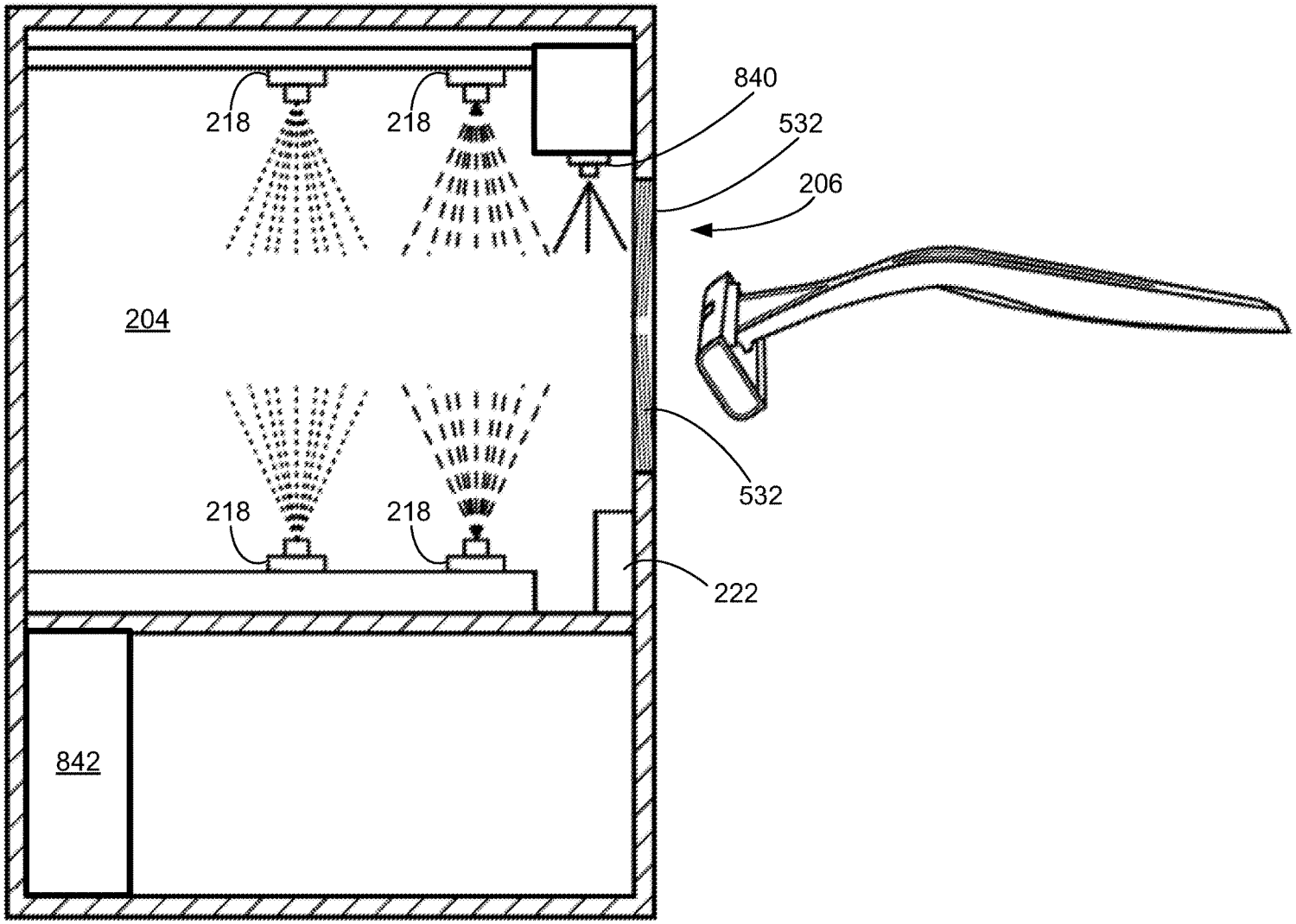
FIG. 8 illustrates a cross-sectional schematic view of another example cleaning device, in accordance with the disclosed technology.

As shown in FIG. 8, the cleaning device can include a lubricating nozzle 840 that is configured to receive and distribute lubricant to some or all personal care tools (e.g., a shaving razor). The lubrication can be stored in a lubricant chamber 842 and distributed onto the personal care tool after a cleaning cycle has been completed. Depending on the type of lubricant used, the lubricant can extend the working life of the personal care tool and/or can replace one or more materials typically used by a user (e.g., shaving cream).

Figure 9:
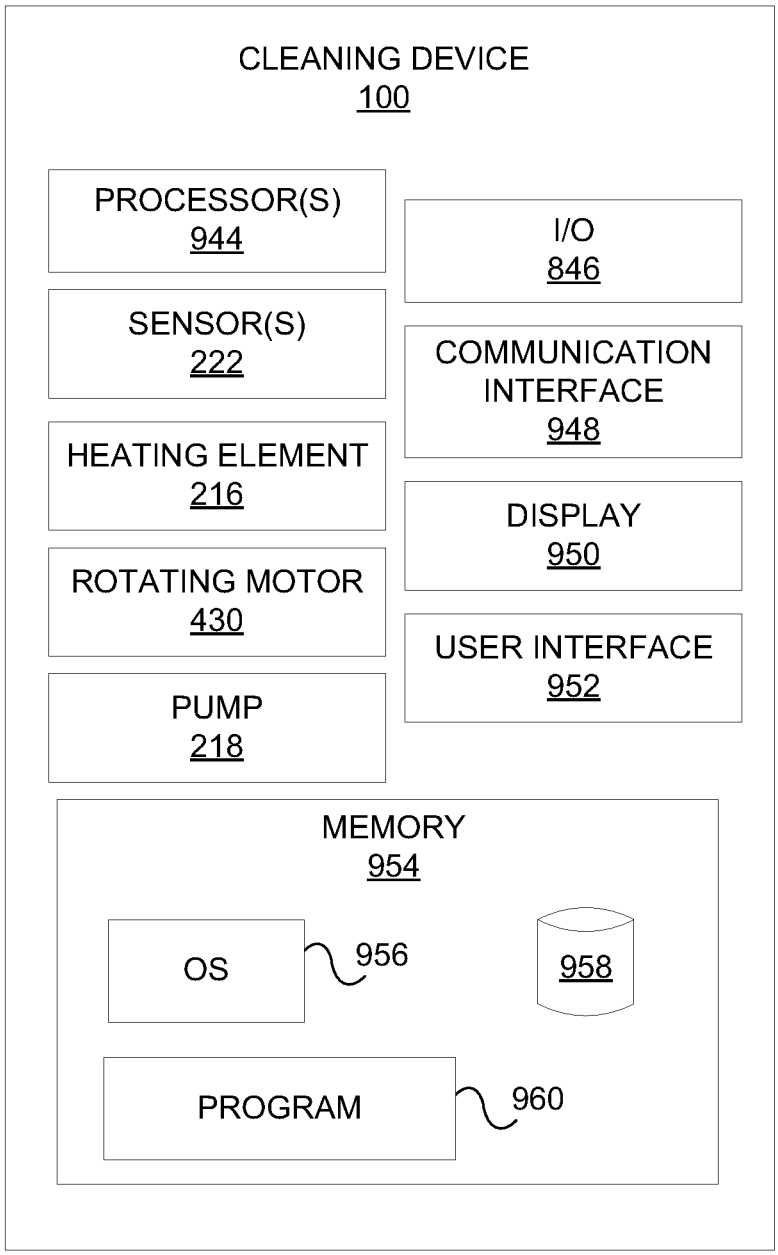
FIG. 9 illustrates a component diagram of an example cleaning device, in accordance with the disclosed technology.

FIG. 9 illustrates an example component diagram of the cleaning device 100. The cleaning device 100 can include some or all of the components shown in FIG. 8, as explained herein. The cleaning device 100 can include one or more processors 944; an input/output (I/O) device 946 such as a transceiver for sending and receiving data (e.g., via Wi-Fi, cellular communications, near-filed communications, Bluetooth™, and the like); a communication interface 948; a display 950; a user interface (U/I) device 952 for receiving user input data; such as data representative of a click, a scroll, a tap, a press, or typing on an input device that can detect tactile inputs (e.g., a physical keyboard, a virtual keyboard); a memory 954, which may include an operating system (OS) 956, a storage device 958, which may be any suitable repository of data, and/or a program 960. As used herein, the controller of the cleaning device 100 can refer to at least one or more processors 944 and memory 954 storing instructions that, when executed by the one or more processors 944, cause the cleaning device 100 (or various components of the cleaning device 100) to perform certain actions.

The controller can be configured to receive data from one or more sensors (e.g., sensor(s) 222, a flow rate sensor or temperature sensor located between the inlet 210 and the cleaning chamber 204) and output instructions accordingly. For example, the controller can be configured to engage the heating element 214 and/or the pump 216 in response to receiving data from the sensor(s) 222 indicating that at least a portion of a personal care tool has entered the cleaning chamber 204. The controller can be configured to distinguish a personal care tool from another object based on the data received from the sensor(s) 222. For example, the controller can compare temperature data indicative of a detected temperature of an object that has entered the cleaning chamber 204 to a predetermined temperature threshold. If the detected temperature is above the predetermined threshold, the controller can determine that the object in the cleaning chamber is a human body part (e.g., hand or fingers), and if the detected temperature is below the predetermined threshold, the controller can determine that the object is a personal care tool.

The controller can be configured to engage or extend the splash guard (e.g., air curtain 533, sliding curtain 632) in response to determining that a personal care tool has entered the cleaning chamber 204. Conversely, the controller can be configured to disengage or retract the splash guard in response to completing a cleaning cycle.

The controller can be configured to receive user input via the U/I device 846 that is indicative of a user selection of a cleaning temperature or duration, and the controller can be configured to output instructions to various components of the cleaning device 100 (e.g., heating element 214, pump 216, air compressor 534, sliding curtain(s) 632) based on the user selection. The user selection can be indicative of a type of personal care tool being cleaned, and the controller can be configured to control various components of the cleaning device 100 accordingly. For example, the controller can be configured to control the various components to clean shaving razors and toothbrushes at different temperatures and for different durations depending on predetermined settings stored in the memory 850.

The disclosed technology also includes a faucet including various aspects described herein. The faucet can be configured to provide cold and hot water such as can be provided by typical faucets. The disclosed faucet, however, can also include a heating element (e.g., heating element 214), a pump (e.g., pump 216), and/or a nozzle (e.g., nozzle 218). The nozzle can be separate from the typical water outlet of the faucet. Alternatively, the nozzle can be integrated into the typical water outlet of the faucet. For example, the nozzle can be disposed at least partially within the typical water outlet of the faucet and can be configured to output high pressure water blasts simultaneously or at different times as water is being outputted from the faucet via the typical water outlet. The disclosed faucet can include a sensor (e.g., sensor(s) 222) configured to detect the presence of an object. The sensor can be configured to determine when an object is within a predetermined distances of the sensor. The disclosed faucet can include a controller, which can provide the same or similar functionalities as described elsewhere herein. Accordingly, the disclosed technology includes a faucet having an integrated cleaning device configured to clean, sanitize, and/or disinfect personal care tools.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described herein as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A cleaning device for cleaning personal care tools, the cleaning device comprising:

a cleaning chamber having an entrance for receiving at least a portion of a personal care tool;

a heating element configured to heat cleaning fluid received by the cleaning device;

a high pressure nozzle configured to output heated cleaning fluid into the cleaning chamber;

one or more sensors configured to detect when a personal care tool has been inserted into the cleaning chamber; and a controller configured to receive data from at least one of the one or more sensors and output initiation instructions to the heating element and to the high pressure nozzle, wherein the cleaning device is configured to attach to an existing sink or a countertop associated with the existing sink.

2. The cleaning device of claim 1 further comprising a pump configured to pump fluid to the high pressure nozzle.

3. The cleaning device of claim 1, wherein the cleaning fluid comprises alcohol or hydrogen peroxide.

4. The cleaning device of claim 1, wherein the cleaning fluid is water.

5. The cleaning device of claim 4 further comprising an inlet configured to receive water from a plumbing line.

6. The cleaning device of claim 5 further comprising a waste outlet configured to discharge waste water into the sink.

7. The cleaning device of claim 1 further comprising a filter configured to filter used cleaning fluid.

8. The cleaning device of claim 7, wherein the filter is integrated into a removeable filter cartridge.

9. The cleaning device of claim 1 further comprising a cleaning fluid reservoir configured to supply cleaning fluid to the heating element and the high pressure nozzle.

10. The cleaning device of claim 1 further comprising a waste reservoir configured to receive used cleaning fluid.

11. The cleaning device of claim 1 further comprising a mesh liner disposed within the cleaning chamber.

12. The cleaning device of claim 1 further comprising a motor configured to rotate the cleaning chamber.

13. The cleaning device of claim 1 further comprising a barrier configured to prevent cleaning solution from escaping the entrance of the cleaning chamber.

14. The cleaning device of claim 13, wherein the barrier comprises an air curtain or a sliding curtain.

15. The cleaning device of claim 13, wherein the barrier comprises a plurality of bristles or a plurality of flaps.

16. The cleaning device of claim 1, wherein the one or more sensors comprise at least one of a mass sensor, an optical sensor, a heat sensor, or a flow rate sensor.

17. The cleaning device of claim 1, wherein the controller is configured to distinguish the personal care tool from another personal care tool based on the data received from the one or more sensors.

18. The cleaning device of claim 17, wherein the controller, upon distinguishing the personal care tool from another personal care tool, is configured to control a temperature of the heating element and/or a flow rate of fluid pumped by the pump based on the identity of the personal care tool.

19. The cleaning device of claim 1 further comprising a splash guard, wherein the controller is further configured to engage the splash guard in response to determining that the personal care tool has entered the cleaning chamber.

20. A cleaning device for cleaning personal care tools, the cleaning device comprising:

a cleaning chamber having an entrance for receiving at least a portion of a personal care tool;

a heating element configured to heat cleaning fluid received by the cleaning device;

a high pressure nozzle configured to output heated cleaning fluid into the cleaning chamber;

one or more sensors configured to detect when a personal care tool has been inserted into the cleaning chamber; and a controller configured to receive data from at least one of the one or more sensors and output initiation instructions to the heating element and to the high pressure nozzle, wherein the cleaning device (i) is configured to attach to a sink or a countertop associated with the sink, (ii) comprises an inlet configured to receive water from a plumbing supply line to the sink, and (iii) comprises a waste outlet configured to discharge waste water into the sink.

* * * * *